United States Patent [19]

Koch

[11] Patent Number: 4,725,222

[45] Date of Patent: Feb. 16, 1988

[54] PROCESS AND APPARATUS FOR COMBUSTION OF LIQUID AND GASEOUS FUELS WITH NITRIC OXIDE-FREE EXHAUST GAS

[76] Inventor: Christian Koch, Mühlweg 13, 8570 Pegnitz, Fed. Rep. of Germany

[21] Appl. No.: 825,395

[22] Filed: Feb. 3, 1986

[30] Foreign Application Priority Data

Feb. 1, 1985 [DE] Fed. Rep. of Germany ..... 3503413

[51] Int. Cl.[4] ..... F23D 3/40

[52] U.S. Cl. ..... 431/7; 431/8; 431/10; 422/177

[58] Field of Search ..... 431/7, 8, 10, 170, 115; 122/40; 422/169, 173, 176, 177; 60/39.5, 723

[56] References Cited

U.S. PATENT DOCUMENTS

| | | | |
|---|---|---|---|
| 2,205,554 | 6/1940 | Brandgee et al. | 431/7 X |
| 3,948,223 | 4/1976 | Benson | 431/10 X |
| 3,982,879 | 9/1976 | Pfefferle | 431/10 |
| 4,145,178 | 3/1979 | Egnell et al. | 431/8 X |
| 4,354,821 | 10/1982 | Kesselring et al. | 431/7 |
| 4,395,223 | 7/1983 | Okigani et al. | 431/10 |
| 4,526,529 | 7/1985 | Bernard et al. | 431/8 X |

FOREIGN PATENT DOCUMENTS

| | | | |
|---|---|---|---|
| 0145920 | 6/1985 | European Pat. Off. | 431/7 |

*Primary Examiner*—Margaret A. Focarino
*Attorney, Agent, or Firm*—Collard, Roe & Galgano

[57] ABSTRACT

A process and apparatus for the nitric oxide-free reaction of liquid and gaseous fuels with heat in heat generators in a plurality of stages. The reaction is carried out in four successive stages, permitting the combustion of a portion of the fuel with a portion of the combustion air in a cooled annular chamber with a stoichiometric or overstoichiometric ratio. The remaining amount of fuel is mixed in a mixing unit connected downstream. The resulting mixture is catalytically reacted to fission or fuel gas with downstream cooling of the fission gas in a heat exchanger. The fission gas so formed is burned in one part of the cooled annular chamber of the second stage. On mixing of the burned combustion gas with the remainder of the fission gas in the catalyst, downstream cooling of the slightly overstoichiometric flue gas so formed is carried out in a heat exchanger.

19 Claims, 6 Drawing Figures

PROCESS AND APPARATUS FOR COMBUSTION OF LIQUID AND GASEOUS FUELS WITH NITRIC OXIDE-FREE EXHAUST GAS

BACKGROUND OF THE INVENTION

The invention relates to a process and apparatus for the nitric oxide-free combustion of liquid and gaseous fuels, wherein fuel gases such as natural gas, liquefied gas, or heating oil are burned in such a way that no nitric oxides are formed.

In gas and oil combustion plants, the fuels are commonly burned in a flame which, at least locally, has temperatures far exceeding 1300° C., which means that nitric oxides are produced. Furthermore, complete combustion requires an excess of air, which prevents the relatively complete utilization of the liberated heat.

Efforts to achieve nitric oxide-free fuel combustion have been made by dividing the combustion into stages in such a way that the formation of nitric oxides in the exhaust gas is reliably prevented. For this purpose, the reaction of the fuel with the air has to take place in all phases of the controlled reaction in such a way that the liberation of heat by combustion reactions and the subsequent cooling of the flue gas take place within a temperature range below 1300° C. or under a reducing atmosphere, or with the reduction of any resulting nitric oxides in a reducing atmosphere by catalytic action.

Efforts to achieve the objective of nitric oxide-free combustion by dividing the reaction into a gasification reaction with partial catalytic oxidation and subsequent cooling of the resulting fuel gas, and combustion of the gasification gas in a second stage, were not successful. The desired objective was not obtained because the hot flame, having a temperature of 1800° C., was not divided into two partial zones of 900° C. This result was due to the intermediate cooling of the gasification gas, which led only to the dissipation of a lower amount of heat, because the volume of the gasification gas represents only a portion of the end or final volume. Thus, significantly higher temperatures were produced in the second stage, which limited the life or durability of the catalysts, and led to the formation of nitric oxide due to overheating, though only to a minor extent. In addition, this created ignition problems in the combustion plant because higher ignition energies for starting the equipment are required under the given conditions of a reducing atmosphere.

Accordingly, it is an object of the present invention to provide a method and apparatus which avoids the above-identified obstacles and achieves combustion of liquid or gaseous fuels, with exhaust gases which are completely nitric oxide-free.

It is also an object of the invention to provide such a method and apparatus which also has a very good utilization efficiency of the combustion heat of the fuel.

SUMMARY OF THE INVENTION

Certain of the foregoing and related objects are readily attained in a process for the nitric oxide-free combustion of fuels including the steps of combusting a portion of fuel with a portion of air in an at least stoichiometric ratio within a cooled annular combustion chamber in a first stage producing a combustion gas therein. The remaining fuel and combustion gas are then mixed and catalytically reacted in the first stage to form fission gas, which is transferred to a second stage via two branches. The portion of the fission gas transferred by one of the branches is combusted in an annular combustion chamber of the second stage. The combusted fission gas is mixed with the fission gas transferred via the other branch in a catalyst in the second stage, thereby causing the mixture of combusted fission gas and fission gas transferred by the second branch to be reacted to form a slightly overstoichiometric flue gas.

Preferably, the flue gas is cooled in a heat exchanger following the second stage and heat is recovered therein. Most desirably, the mixing step in the first and second stages occurs at the head of each of the cooled annular chambers, which are centrally located, in a mixing gap formed between a perforated plate and a top cover plate of each of the catalysts, and the mixture of gases is then transferred into the catalysts. In addition, the mixture of remaining fuel and combustion gas may be further mixed during the transfer of the mixture from the annular chamber and mixing gap into the catalyst. It is also desirable that when the process is initiated, liquid fuel be added after the first stage, a portion of the fission gas be returned to the mixing gap of the first stage, and a portion of the liquid fuel be admitted into the annular chamber of the first stage for ignition. Furthermore, a heating medium may be heated in the heat exchanger of the second stage and conducted countercurrently with respect to the combustion stages, the heat exchanger of the second stage thereby serving as a primary heating stage, permitting maximum utilization of the caloric value of the fuel.

In a preferred embodiment of the invention, liquid fuel is injected into the first stage annular chamber with an infeed of 30 to 60% of the stoichiometric amount of air, in such a way that only 20 to 50% of an injected amount of liquid fuel is admitted into the annular chamber. The remainder of the liquid fuel remains in a storage unit, from where it is mixed with the combustion gases of the injected fuel, and transferred into a catalyst.

An apparatus for nitric oxide-free combustion of fuel in a plurality of stages includes a first reaction stage gasification unit, and a second reaction stage combustion unit, each of these units having a combustion chamber with a combustion zone, cooling means and ignition means, means for mixing fuel and combustion gases, and a heat exchanger joined to a catalyst chamber. Preferably, the means for mixing are disposed at the top end of each of the chambers and include a perforated plate and a catalyst cover plate. An eddying chamber disposed inbetween the means for mixing and the catalyst chamber may also be included. The catalyst preferably includes an insulated honeycomb structured catalyst block supported in a cylinder. Most desirably, an oil injection valve is disposed in the combustion chamber and opposed by a porous plate having a bore, which on receiving oil reflects from 20 to 50% of the oil into the combustion zone, and at least one catalyst plate is disposed inbetween the porous plate and the catalyst chamber.

According to the invention, nitric oxide-free combustion in achieved by nearly completely burning only about half of the gaseous fuel (i.e., within the range of 30% and 70%) with the total amount of air supplied in the first (gasification) stage, and with the combustion being carried out in a preliminary stage in a cooled annular or ring-type combustion chamber. The hot combustion gases are cooled in the annular chamber, which has only 1–2% of the total heat exchange surface area, to temperatures in the range of only 1200° to 1600° C.

The combustion gases are mixed with the total remaining primary fuel at the head or top of the annular chamber and are then passed in the mixed state into a catalyst, which under cooling, converts the gas mixture into a fission gas containing CO and $H_2$. This conversion is required because such a converted fission gas burns more readily, and soot-forming secondary reactions, after the mixing of the gas, due to catalytic reactions are prevented. On exiting from the catalyst the fission gas is cooled in a first stage heat exchanger to temperatures above the dew point and transferred in two partial streams or branches into the second combustion stage.

With a liquid fuel, the reaction in the first stage is achieved by returning a partial stream of the resulting gasification or fission gas into the annular chamber of the first stage, and completely burning this partial stream with a partial stream of the air. The liquid fuel in this process is added to the hot combustion gas at the head of the first stage. As with the gaseous fuel, the mixture is converted into a fission gas in the catalyst of the first stage. In addition, it is possible to arrange the top ceramic or metal plate of the catalyst chamber unit in the location where the liquid jet impacts. The plate has a bore sufficiently small that only about half of the liquid or oil will directly contact the next plate. Barely half of the injected liquid fuel is reflected and burned in the flame, which is disposed above the plate.

The resulting combustion gases are partially cooled in the process by radiation and convection to the surrounding water-cooled surfaces. These gases mix with the unburned oil to form a reactive mixture, and then react to form fission gas upon transfer into the following catalyst block. However, contrary to the gaseous fuel, with the liquid fuel, not only may the total amount of gasification or fission gas be passed into the second stage, but it is also possible to return a partial stream to the annular chamber of the first stage. For the starting action used until the gasification gas is formed, small partial quantities of the liquid fuel are admitted into the annular chamber of the first stage.

For the purpose of carefully treating the catalyst of the second stage, about half of the gasification gas (30 to 90%) is burned in the second stage annular chamber with the total amount of the combustion air of the second stage, and partially cooled by the water jacket of the annular chamber. Owing to the small surface of the annular chamber, cooling takes place in the chamber to about 1000° C. (800° to 1100° C.), so that in the head of the chamber, where the remaining amount of gasification gas is admixed, a mixed quantity of gas with a temperature of about 600° C. is obtained. This mixture is reacted into a clean flue or exhaust gas with a low air excess in the following second stage catalyst.

The following second stage heat exchanger provides for the almost complete transfer of the heat contained in the exhaust gas to the heating medium contained in the tubes. The heating medium may be, for example, industrial water or water from a heating circuit. The nearly complete heat transfer is promoted by the fact that due to the combustion of the gas in the catalyst, no flame volume and no soot-containing by-products, which would deteriorate the transfer of the heat to the tubes, are produced.

In the apparatus according to the invention, mixing heads in the combustion chambers are closed by the perforated plates of the two stages, and gas inlets are disposed in the top part of the head with gas outlets through the perforated plates. Cooled annular chambers with mixture inlets, ignition devices, a centrally disposed catalyst, and following heat exchangers are provided. The apparatus furthermore contains gas transfer lines from the first stage, with an inlet into the annular chamber of the second stage, and an infeed leading into the mixing head of the second stage.

Other objects and features of the present invention will become apparent from the following detailed description considered in connection with the accompanying drawings, which disclose several embodiments of the invention. It is to be understood that the drawings are to be used for the purpose of illustration only, and not as a definition of the limits of the invention.

BRIEF DESCRIPTION OF THE DRAWINGS

In the drawings, wherein similar reference characters denote similar elements throughout the several views.

DETAILED DESCRIPTION OF THE PREFERRED EMBODIMENTS

Figure 1:
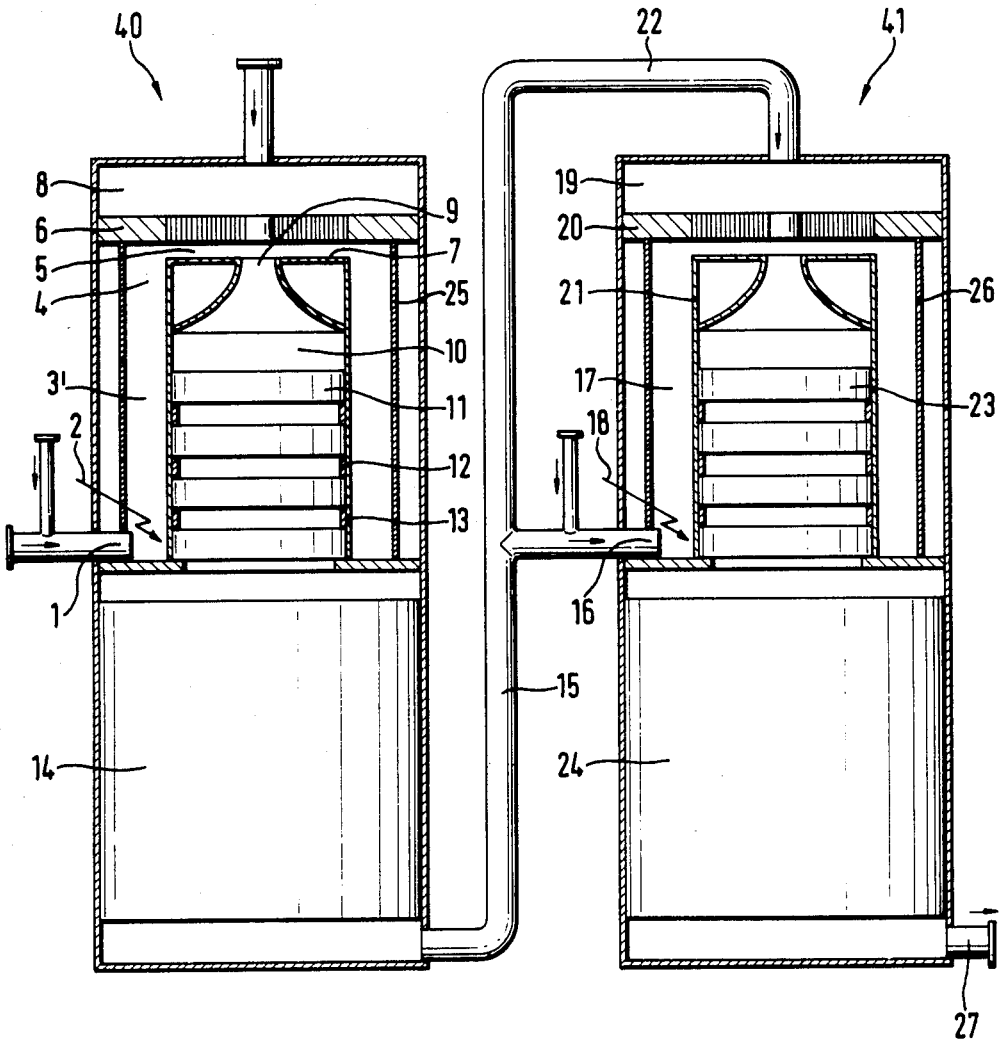
FIG. 1 is a schematical representation of the apparatus for nitric oxide-free combustion according to the invention.

Turning now in detail to the appended drawings, therein illustrated is a novel apparatus for nitric oxide-free combustion embodying the present invention, which as shown in FIG. 1 includes individual stages and components. Elements 1–13 and 16–24 therein collectively form the fission gas producer unit 40 in the first stage, and the combustion unit 41 in the second stage, respectively. In operation, an entry or inlet 1 supplies a gas/air mixture into the first stage. By way of inlet 1, the stream of fuel gas, which is mixed with the combustion air of the first stage, enters the annular chamber 3 of the first stage. The flow of fuel gas and air is ignited by an ignition device 2, for example a spark plug. The hot combustion gas, in its upward course through annular chamber 3, flows along the medium-cooled (e.g., water-cooled) outer wall 25, where it is cooled somewhat. The partially cooled off gas arrives at the head 4 of annular chamber 3, where the remaining amount of fuel gas is admixed with the still hot combustion gas. Advantageously, a mixing gap 5 is used for the mixing, gap 5 being formed by the perforated plate 6 and the top surface 7 of the catalyst housing or chamber 13. In gap 5, the hot combustion gas sucks in the remaining amount of fuel gas, which is admitted into the gas chamber 8 from the top by way of perforated plate 6.

The mixing of the components is enhanced by the inlet opening 9 and the mixing chamber 10 within catalyst chamber 7, which are disposed ahead of the catalyst 11, so that as the hot mixture enters catalyst 11, it has a homogeneous distribution of concentration. Such homogeneous distribution of the concentration is required because the catalyst may consist of a catalyst honeycomb which prevents mixing of the gases in the catalyst. Catalyst 11 is clamped in the housing 13 by an insulation mat 12, and it is thermally insulated, so that the active substance of the catalyst remains protected against the higher temperatures in annular chamber 3 surrounding the catalyst. A heat exchanger 14 is arranged following catalyst 11 and cools the resulting fission gas to a temperature above the dew point temperature.

The fission gas passing from heat exchanger 14 into the conduit 15 is conducted through the conduit 16 together with the combustion air of the second stage and passed into the annular chamber 17 of the second stage. The ignition device 18 is arranged in the second stage and ignites the mixture in annular chamber 17. The combustion of the fission gas in annular chamber 17 is highly overstoichiometric, i.e., the amount of air more than suffices for the complete combustion of the gas. The gas chamber 19 is arranged at the top end of the annular chamber 17. Chamber 19 and the perforated plate 20 and the top cover plate of the catalyst chamber 21 jointly form the mixing zone for mixing the combustion gas from annular chamber 17 with the remaining amount of fission gas. The partial amount of fission gas is introduced into annular chamber 17 by way of the conduit 22.

The mixing of the combustion gas with excess air and the fission gas permits the reaction, in the following catalyst 23, of the gas to form a slightly overstoichiometric flue gas, from which the heat can be efficiently recovered. The heat recovery takes place in the following heat exchanger 24, which permits cooling of the flue gas as completely as possible.

Figure 2:
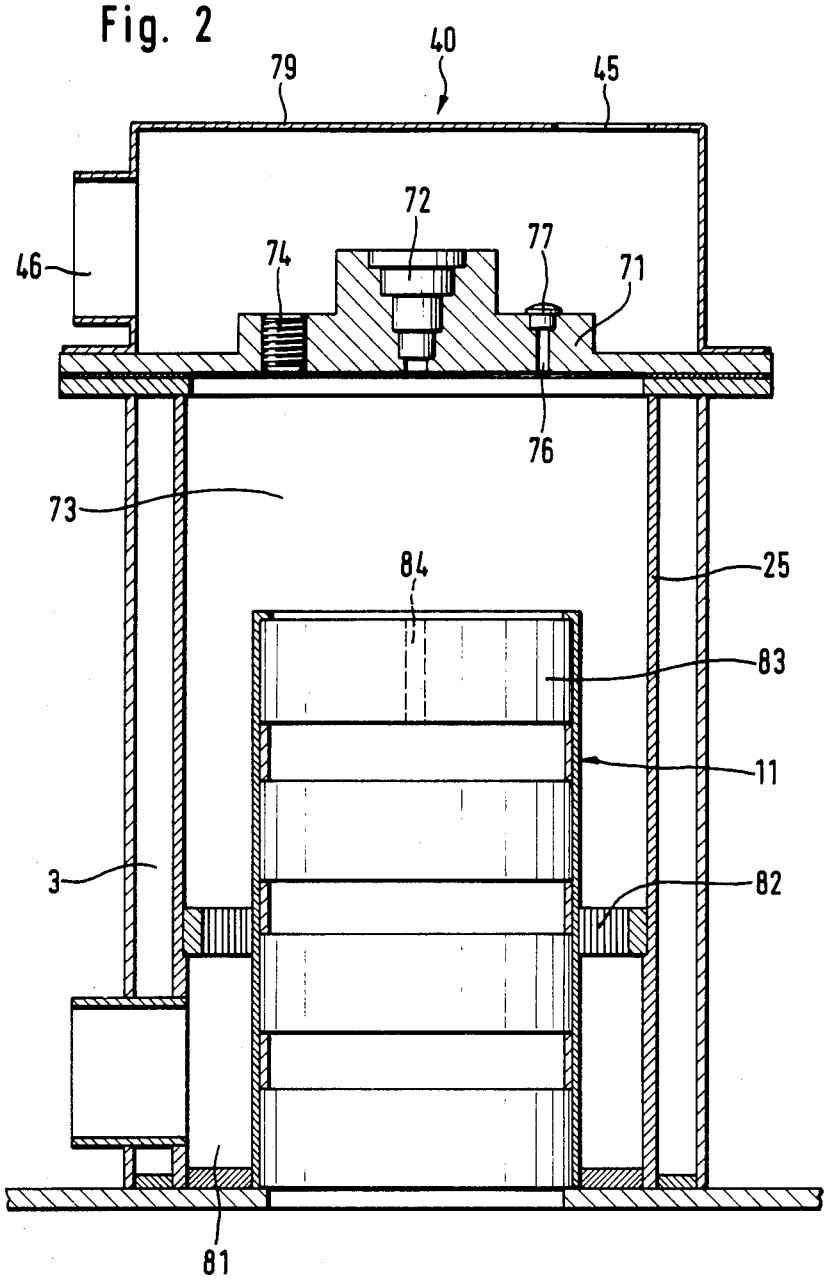
FIG. 2 is an enlarged schematical representation of a second embodiment of the gasification or fission gas producing unit of the apparatus shown in FIG. 1.

FIG. 2 shows another design for use with liquid fuel of the fission gas producer unit 40. Reference numeral 71 refers to the basic body containing both the ignition system 74 and the injector nozzle 72 for discontinuous and controlled injection of the fuel. Numeral 73 designates the flame zone, where the flame is formed by reflection of a portion of the oil, mixing with the gasification air, with ignition by ignition system 74. The flame is cooled by the surrounding water-cooled walls 25. A portion of the gasification air is directly conducted close to the ignition system by way of a small bore 76, which is provided with an air filter 77. The basic body is cooled in such a way that the required gasification air is sucked through the inlet 45 of the covering hood 79 in order to subsequently stream along the surface of basic body 71 and then through the tube 46 into the base 81 of the annular combustion chamber, below the flame barrier 82.

The hot combustion gases forming or generated in flame zone 73 mix with the unburned oil, which was not reflected by the storage plate 83 with the bore 84. The mixture enters the catalyst 11, which consists of one or a plurality of catalyst blocks. In catalyst 11, the mixture consisting of hot combustion gas and oil vapor reacts to form a fission gas substantially consisting of $CH_4$, CO, $H_2$ and the combustion gas components. The hot fission gases are cooled downstream in a following heat exchanger and, in mixture with air, reacted or burned into flue gas in the second stage in accordance with German Patent Application No. P 35 03 413.0.

Figure 3:
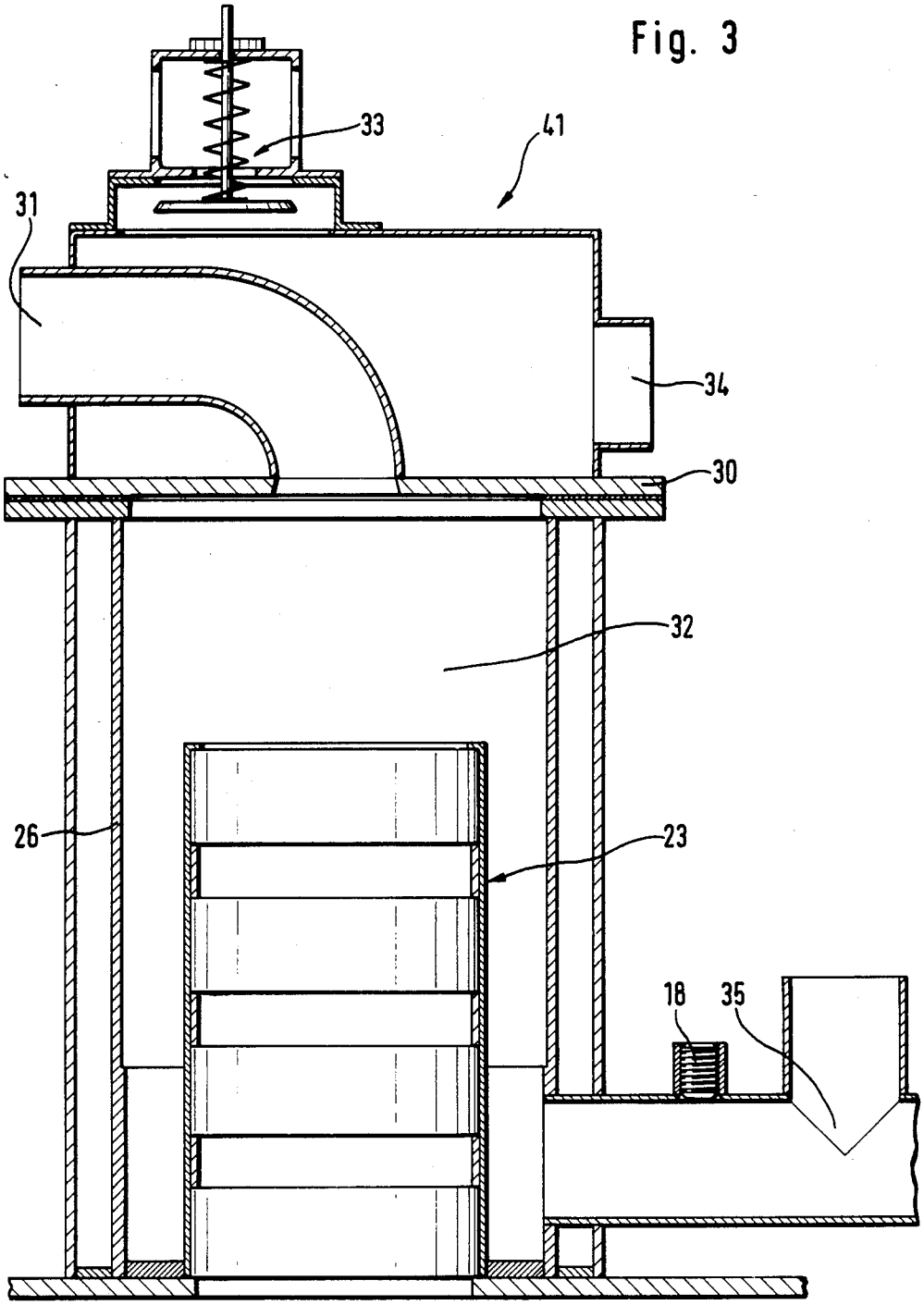
FIG. 3 is an enlarged schematical representation of the combustion unit of the apparatus shown in FIG. 1.

Combustion unit 41 according to the invention is illustrated in FIG. 3 wherein base plate 30 has an inlet 31 for permitting the infeed of a portion of the fission gas into the combustion chamber 32. The combustion air flows towards the outlet opening 34 by way of the throttling device 33 and in its course cools base plate 30. The air so preheated mixes with the remaining fission gas at junction 35. The mixture is ignited by ignition system 18. The flame is cooled on the surrounding water-cooled wall surface 26. In combustion zone or chamber 32, the combustion gases mix with the fission gas from inlet 31. In the catalyst system 23, which may be comprised of one or of a plurality of catalyst blocks, the oxidation of the remaining fission gas products into exhaust or flue gas takes place.

Figure 4A:
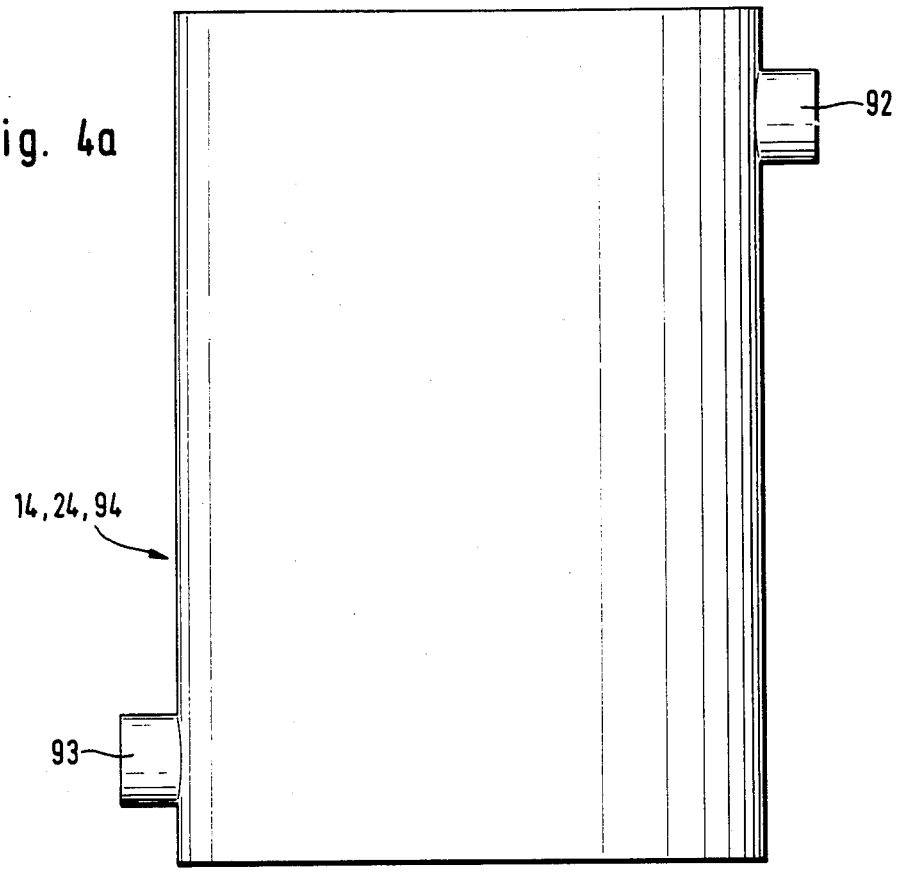
FIG. 4*a* is a side elevational view of the heat exchanger element of the apparatus shown in FIG. 1.
Figure 4B:
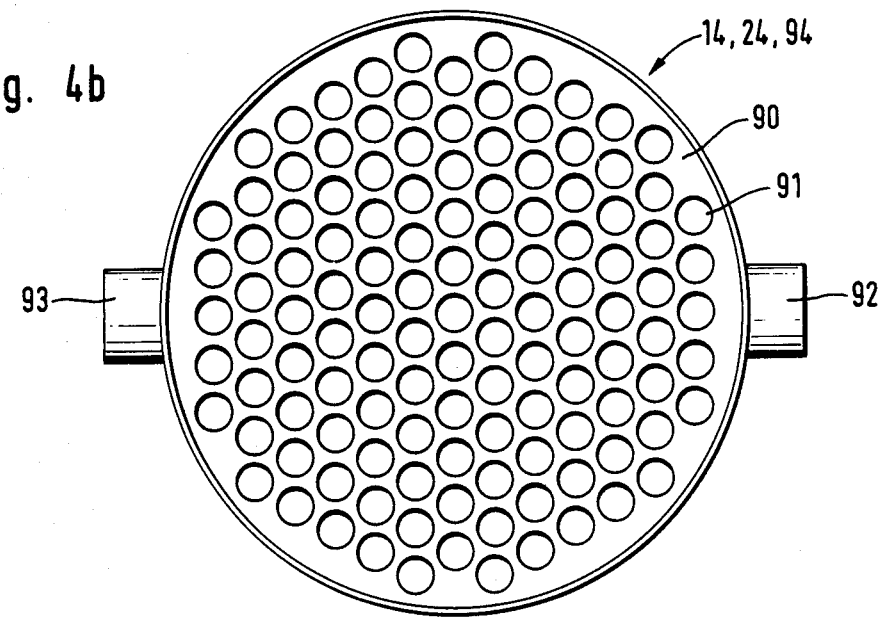
FIG. 4*b* is an end view of the heat exchanger element shown in FIG. 4*a*.

FIG. 4 shows the design of heat exchanger element 14 or 24. The fission or flue gas flows through the tubes secured in the base plate 90 and heats the cooling water, which enters at point 92 and exits at point 93 on the jacket side. The round outer cylinder of the heat exchanger 94 permits an elevated water pressure with thin walls (low wall thicknesses).

Concerning the heat exchangers, it has been found that it is useful to use straight-tube-type heat exchangers which arranged in 3 or 4 blocks one after another, effect cooling of the fission gas, precooling of the combustion gas, after-cooling of the fission gas, and condensing of the flue gas moisture, which thus heats the heating water countercurrently or in a counterflow manner.

Figure 5:
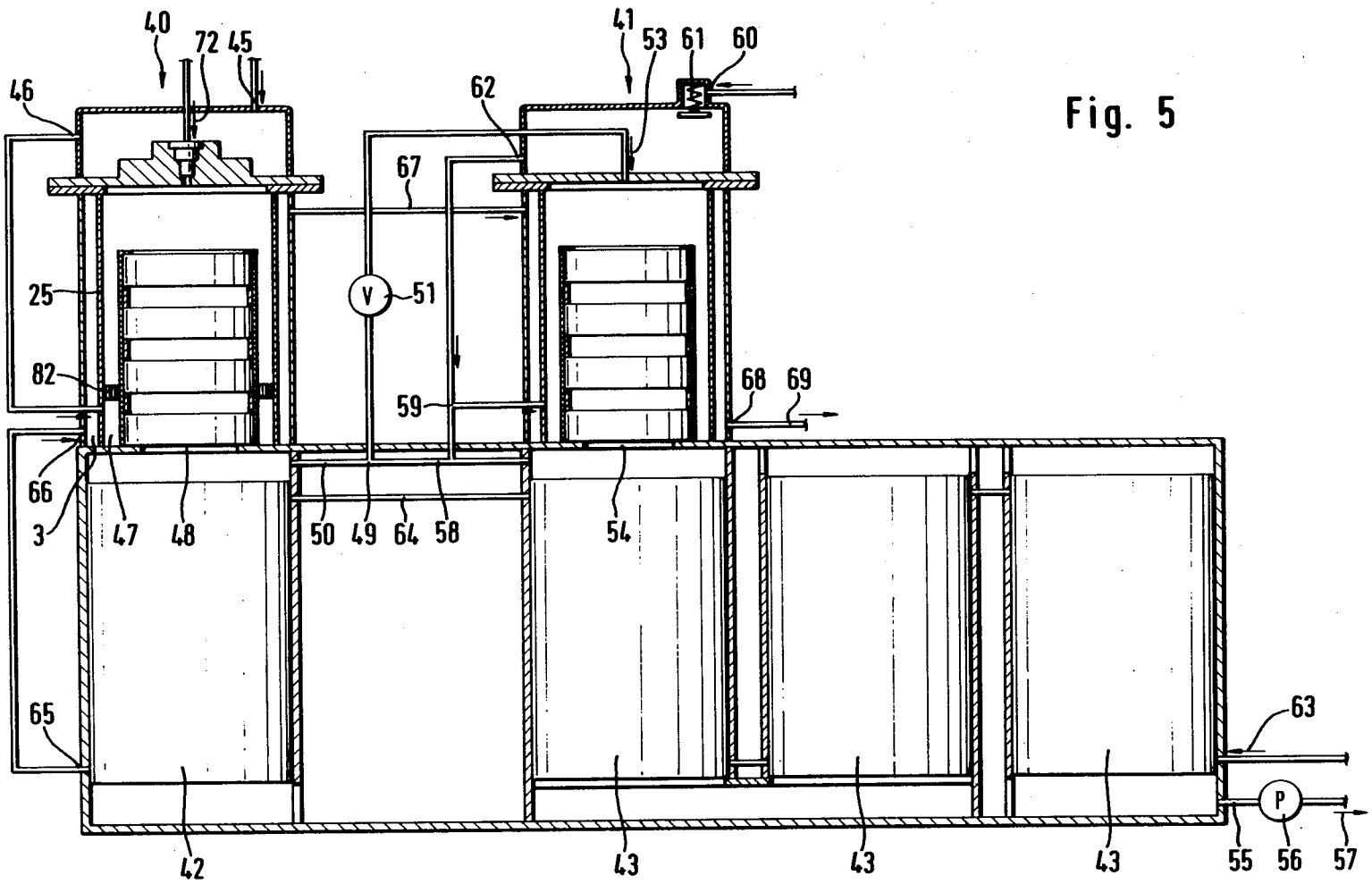
FIG. 5 is a schematical flow diagram illustrating the design and flow pattern of the individual medium paths in the apparatus shown in FIG. 1.

The design and flow circuits for an oil burning embodiment of the invention are shown in FIG. 5. Combustion unit 41 in and fission gas producer unit 40 therein are further detailed FIGS. 1–3. Fission gas heat exchanger 42 is analogous to heat exchanger 14 in FIG. 1, while heat exchanger system 43 consists of one or more heat exchanger elements of the same design, e.g., a design as shown also in FIG. 3.

The heating oil for the generation of heat and fission gas is injected at port 72. The air for the partial combustion enters the covering hood at inlet 45, exits from there via tube 46, and is then conducted into annular chamber 3 beneath the flame barrier at base region 47. The fission gas exits from the fission gas generation unit 40 at point 48 and is cooled in heat exchanger 42. A portion of the fission gas exits from the empty flue 50 at point 49 in order to be conducted into the head of the combustion unit 41 at point 53 by way of a controlling element or valve 51. Via tube 58, the remaining portion of the fission gas is branched off and admixed at point 59 with are which enters the covering hood at point 60 by way of the throttling element 61 and exits from the hood at point 62. The hot flue or exhaust gases exit from the combustion unit 41 at point 54, are cooled in the heat exchanger system 43, and exit from the apparatus via tube 55. The blower 56 generates in the apparatus the resistance-conditioned under pressure and thus sucks all gases through the device and feeds these gases into the smoke stack 57.

In order to facilitate heat exchange, cold water enters the heat exchanger system 43 at point 63, is conducted by way of the conduit 64 into fission gas generator heat exchanger 42 (stage 1), and is discharged from the heat exchanger at point 65. At point 66, the water enters the base of annular gap chamber 3 of fission gas generating unit 40 and passes through jacket 25. At the head of unit 40, the water is passed via the conduit connection 67 into the annular gap of combustion unit 41. Heated to its operating temperature, the warm water exits from the apparatus at point 68 in order to be passed on to the individual consumers via the conduit 69.

The invention will now be explained more fully in a number of examples which are, however, only given by way of illustration and not of limitation.

EXAMPLE 1

This example describes the temperature and volume flow characteristics of a nitric oxide-free combustion of natural gas with a thermal output of 100 kW. The data relating to the volume flows relate to the normal state or condition (0° C.; 760 Torr).

Referring to FIG. 1, via conduit 1, 0.013267 $m^3/s$ air and 0.001393 $m^3/s$ $CH_4$ flow tangentially into annular chamber 3 of the first stage and are ignited therein by a spark plug 2. The gas mixture is burned in the base of annular chamber 3 at a temperature of about 2060° C. to form 0.01466 $m^3/s$ of combustion gas. By means of a spiral made of heat-resistant material which may be inserted into the system, the flow of combustion gas is forced to coil or turn around the outside of catalyst housing 13 about 3 times while on its way to the head or top of annular chamber 3. The combustion gases stream along the water-cooled outside wall 25 where they are cooled to about 1600° C. When entering annular gap 5, the exhaust gases accelerate and generate an underpressure, which causes methane to be sucked in from gas chamber 8 via perforated plate 6 at a rate of 0.001393 $m^3/s$.

By way of inlet opening 9 and mixing chamber 10, the gas, which is now homogeneously mixed, is passed through catalyst 11, where it reacts to form fission gas in endothermic processes at a rate of 0.01884 $m^3/s$ Before entering heat exchanger 14 of the first stage, the gasification or fission gas has a temperature of 886° C. At the outlet, it exits with a temperature of about 130° C.

The fission gas exists from the first combustion stage by way of conduit 15. By way of conduit 16, 0.01413 $m^3/s$ fission gas and 0.013267 $m^3/s$ air flow tangentially into annular chamber 17 of the second stage and are ignited therein by means of ignition system 18. The gas mixture is burned at the base of annular chamber 17 at a temperature of 1280° C. into combustion gas at a rate of 0.02531 $m^3/s$. On its way to the head of annular chamber 17, the gas circulates about 3 times around the outside of catalyst housing 13 with the help of a heat-resistant spiral, and it is cooled in this course to about 1060° C. on water-cooled outer wall 26.

In mixing zone or chamber 10, the remaining amount of fission gas is added to the combustion gas via conduit 22, gas chamber 19 and perforated plate 20 at a rate of 0.00471 $m^3/s$, whereupon the gases are homogeneously mixed via the inlet opening and mixing chamber and passed to catalyst 23. In an exothermic process, the combustion gas/fission gas mixture is reacted to form flue gas at a rate of 0.02932 $m^3/s$.

Before entering heat exchanger 24 of the second combustion stage, the flue gas has a temperature of 1260° C. In heat exchanger 24, it is cooled to about 45° C., and it exits from the second combustion stage free from nitric oxide by way of conduit 27.

EXAMPLE 2

The energy of a stream of heating oil of 0.00046 kg/s, which conforms to an equivalent energy potential of 20 kW, is to be reacted free from nitric oxide and used for heating water to 90° C. Referring now to FIGS. 2, 3 and 5, 20° C. air flows with a volume flow rate of 9.59 $m^3/h$ across body 71 of fission gas generating unit 40 and is heated in its course by about 5° C. Via a conduit connection it is subsequently passed into the base and, above the flame barrier 82, into annular mixing gap 3 of the fission gas generating unit. Above flame barrier 82, the atmospheric oxygen is burned with a portion of the injected oil at an average temperature of 1900° C. The combustion gas generated in the process at a rate of 10.39 $m^3/h$ is combined with the remaining oil in the catalyst system 11 with dissipation of heat, forming fission gas at a rate of 12.98 $m^3/h$ at an average temperature of 955° C. In the following heat exchanger 42, the fission gas is cooled to 100° C.

The 100° C. stream of fission gas (12.98 $m^3/h$) is divided in the combustion stage in such a way that 9.73 $m^3/h$ is passed into the base of annular gap 17 and 3.25 $m^3/h$ is passed into the head via tube 31. The 9.59 $m^3/h$ of air required for the combustion passes across the cover plate 30 of the combustion zone head and is heated on its way by about 3° C. Together with the stream of fission gas, which is admitted into the base of annular gap 17, it is blended and ignited. At about 1350° C., the gas mixture is burned to form 17.82 $m^3/h$ of combustion gas. With dissipation of heat, the combustion gas is conducted into the head of the combustion chamber, where it is admixed with the remaining fission gas. In following catalyst system 23, the still-free oxygen from the exhaust gas stream oxidizes with the components of the fission gas to form a total of 20.55 $m^3/h$ of exhaust gas. The exhaust gas is cooled to about 43° C. in following heat exchanger system 43 with condensation.

By means of the above-described gasification and combustion process, about 35% of the energy contained in the heating oil is liberated in the gasification stage, and about 65% of the energy is liberated in the combustion stages. The water-cooled walls of the gasification and combustion stages assume an important role in the heat reduction because they jointly dissipate about 20% of the sensible heat into the water.

EXAMPLE 3

Referring now to FIGS. 1, 3 and 4, a $CH_4$/air mixture flows tangentially through inlet 1 into annular chamber 3 having a width of about 5 to 30 mm and a height of about 150 to 300 mm, and is ignited in the base of the chamber by a spark plug 2. Subsequently, the combustion gas flows under cooling into head 4 of the annular chamber. In annular mixing gap 5, which has a width of about 4 to 15 mm, the combustion gas mixes with the remaining $CH_4$, which is admitted by way of perforated plate 6. Thereafter, the mixture passes through inlet opening 9 into mixing chamber 10 and subsequently flows through catalyst 11. Both the mixing chamber and the catalyst have a diameter in the range of 100 and 150 mm.

Heat exchanger 14 of the first combustion stage, within the zone where the gas temperature exceed 700° C., is comprised of plain tubes 91, whereas in the zone of lower temperatures it is comprised of ribbed tubes. Owing to the honeycomb design of catalyst 11, the length of the flame is kept very short, so that no empty flame/radiation space is required and the first layer of plain tubes thus may be installed about 10 mm downstream of the catalyst. By installing several gas flues, the fission gas travels at a rate in the range of 1–2 m/s.

In the second combustion stage, a partial stream of the fission gas is branched off, admixed with air, and passed into the base of annular duct 17, where it is ignited. Annular duct 17 has a width from 5 to 30 mm and a height from about 150 to 300 mm. The gas feeding inlets 1 (first stage) and 16 (second stage) each are equipped with flame barriers 82.

The flow and mixing path of the gas in the second combustion stage are identical with the one in the first combustion stage. Also, the dimensions of annular gap 5; the mixing unit; and the catalyst; are approximately equivalent to the dimensions of their counterparts in the first combustion stage. The admixing of the remaining fission gas is also approximately equivalent in both stages. The design criteria for heat exchanger 24 are the same as those for heat exchanger 14, i.e., plain tubes within the zone of gas temperatures exceeding 700° C., and ribbed tubes in the zone of lower temperatures. Furthermore, several gas flues are installed for the purpose of maintaining a reasonable gas rate. Also in the present case, the catalytic combustion and thus the short length of the flame, permit the installation of the first layer of plain tubes about 10 mm downstream of the catalyst.

EXAMPLE 4

With reference to FIGS. 2, 4 and 5, the air for the gasification stage flows through inlet 45 (having a diameter of 150 mm) in covering hood 79, and from there through tube 46 (nominal diameter 40 mm) and into the base 47 of annular chamber 3 with an outside diameter of 169 mm and an inside diameter of 152 mm. From there, the air passes flame barrier 82, which, with its bores, leaves about 40% of the free area of annular space 3 open (see FIG. 5).

In flame zone 73, a portion of the oil is burned and the remaining portion with the combustion gas is admitted into catalyst 11, which consists of three individual catalyst blocks each having a depth of 30 mm and a diameter of 100 mm. The limitation of flame zone 73 is formed by a storage plate 83, which reflects 50% of the oil on impact, in the flame zone, whereas the other 50% is permitted to pass through a fine bore 84 of about 1 mm. The outside dimensions of storage plate 83 are the same as those of the individual catalyst blocks.

Downstream of the catalyst system the fission gas flows through heat exchanger 42 having a diameter of 159 mm and a length of 230 mm, whereby the water to be heated is flowing on the jacket side and the gas is flowing on the tub side by way of 121 tubes (nominal width 10 mm).

On exiting from heat exchanger 42 the gas flows from the bottom upwardly through empty flue 50 measuring 200×180 mm. At the end of the flue, a portion of the fission gas is conducted into the head of the combustion unit by way of tube 31 (nominal width 40 mm), controlled by a shutoff flap or valve 51. Also by way of tube 58 with a nominal width of 40 mm, the remaining fission gas is withdrawn at the end of emply flue 50, mixed with the air which is sucked in via the covering hood 79, and ignited. The gases then pass into annular chamber 17 of combustion unit 41, which has the same dimensions as fission gas generating unit 40. In combustion zone 32, mixing with the fission gas takes place, and the reaction to form exhaust gas takes place in catalyst system 23, which has a structure identical to the one of catalyst system 11 of the fission gas generating unit 40. In the present embodiment, only storage plate 83 (FIG. 2) is replaced by an additional catalyst block.

In heat exchanger system 43, the exhaust gas is cooled. The system 43 is comprised of three individual heat exchangers each having the same dimensions and the same structure as the heat exchangers for cooling the fission gas. The heat exchange itself takes place countercurrently. Via tube 55 with a nominal width of 40 mm, exhaust gases are sucked off, via blower 56 generating an underpressure of 50 mm water column, and passed into smoke stack 57 (see FIG. 5).

While only several embodiments and examples of the present invention have been described, it is obvious that many changes and modifications may be made thereunto, without departing from the spirit and scope of the invention.

What is claimed is:

1. A process for the nitric oxide-free combustion of fuels comprising the steps of:

combusting a portion of fuel with a portion of combustion air in an at least stoichiometric ratio within a cooled annular combustion chamber in a first stage producing a combustion gas therein;

mixing the remaining fuel and the combustion gas;

catalytically reacting the mixture of remaining fuel and combustion gas in the first stage to form fission gas;

transferring the fission gas to a second stage via two branches;

combusting the portion of the fission gas transferred by one of the branches in an annular combustion chamber of the second stage; and mixing the combusted fission gas with the fission gas transferred via the other branch in a catalyst in the second stage, thereby causing the mixture of combusted fission gas and the fission gas transferred by the second branch to be reacted to form a slightly overstoichiometric flue gas.

2. The process according to claim 1 further comprising:

cooling the flue gas in a heat exchanger following the second stage and recovering heat therein.

3. The process according to claim 1, wherein the mixing step in the first and second stages occurs at the head of each of the cooled annular chambers which are centrally located in a mixing gap formed between a perforated plate and a top cover plate of each of the catalysts, and the mixture of gases is then transferred into the catalysts.

4. The process according to claim 3, wherein the mixture of remaining fuel and combustion gas is further mixed during the transfer of the mixture from the annular chamber and mixing gap into the catalyst.

5. The process according to claim 1, further comprising the steps of:

adding a liquid fuel after the first stage;

returning a portion of the fission gas to the mixing gap of the first stage; and admitting a portion of the liquid fuel into the annular chamber of the first stage for ignition, when the process is initiated.

6. The process according to claim 2, further comprising the step of:

heating a heating medium in the heat exchanger of the second stage and conducting the medium countercurrently with respect to the combustion stages, the heat exchanger of the second stage thereby serving as a primary heating stage, permitting maximum utilization of the caloric value of the fuel.

7. The process according to claim 1, wherein liquid fuel is injected into the first stage annular chamber with an infeed of 30 to 60% of the stoichiometric amount of air, in such a way that only 20 to 50% of an injected amount of liquid fuel is admitted into the annular chamber, the remainder of the liquid combustion gases of the injected fuel, and transferred into a catalyst.

8. The process according to claim 7, wherein the liquid fuel is oil and the storage unit is a storage plate having a center bore admitting a portion of the injected oil directly into a space disposed after the plate, from where the oil is discharged in mixture with the combustion gases and transferred into the catalyst.

9. The process according to claim 8, wherein the discharge of heat from the fission gas generation process takes place first in the first stage combustion chamber cooling system and then in the second stage fission gas cooling system.

10. The process of claim 7, wherein the cooling of the combustion and flue gases takes place countercurrently with respect to the heating of the heating medium in two combustion chamber cooling systems and about 4 straight-tube heat exchangers.

11. An apparatus for nitric oxide-free combustion of fuel comprising:

a first combustion chamber having a combustion zone, a means for introducing a fuel and air mixture into said combustion zone, a means for igniting said fuel and air mixture thereby forming a hot combustion gas, a means associated with the wall of said combustion chamber for partially cooling said combustion gas, a means for mixing said partially cooled combustion gases with additional fuel after said combustion, a catalyst for reacting with said partially cooled combustion gases mixed with said additional fuel to form a fission gas, said air introduced into said combustion chamber being insufficient to react with said fuel;

a second combustion chamber;

a first conduit for transporting part of said fission gas to a second combustion chamber;

said second combustion chamber including means for introducing more than sufficient air for the complete combustion of said part of said fission gas into a combustion zone therein, a means for igniting said part of said fission gas in said combustion zone;

a second conduit for transporting the remainder of said fission gas to said second combustion chamber after said combustion zone therein; and said second combustion chamber further having a means for mixing the combusted part of said fission gas and said remainder of said fission gas and reacting said mixing with a catalyst thereby forming a slightly overstoichiometric flue gas.

12. The apparatus according to claim 11, further including a heat exchanger for recovering the heat from said flue gas.

13. The apparatus according to claim 1!, wherein said means for mixing said partially cooled combustion gases with additional fuel and for mixing said combustion fission gases and said remainder of said fission gases includes a perforated plate and a catalyst cover plate located after said combustion zones in said first and second combustion chambers.

14. The apparatus according to claim 11, further comprising a means for eddying said partially cooled combustion gas with additional fuel in said first combustion chamber or said combustion fission gas and said remainder of said fission gas in said second combustion chamber prior to reacting said mixtures with said catalysts.

15. The apparatus according to claim 11, wherein said catalyst is of the type used for engine exhaust gas detoxification and comprises an insulated honeycomb structed block supported within a cylindrical catalyst chamber.

16. The apparatus according to claim 11, further comprising an oil injection valve located in said first combustion chamber and opposed by a porous plate which, on receiving the oil, reflects from 20 to 50% of said oil into said combustion zone.

17. The apparatus according to claim 16, wherein said porous plate has a bore.

18. The apparatus according to claim 16, wherein at least one catalyst plate is disposed inbetween said porous plate and said catalyst.

19. The apparatus according to claim 12, wherein the heat exchangers are straight tube heat exchangers.

* * * * *